United States Patent [19]

O'Leary

[11] Patent Number: 4,533,123

[45] Date of Patent: Aug. 6, 1985

[54] LIQUID MIXING DEVICE

[75] Inventor: Richard P. O'Leary, Wayne, Pa.

[73] Assignee: Betz Laboratories, Inc., Trevose, Pa.

[21] Appl. No.: 607,494

[22] Filed: May 7, 1984

[51] Int. Cl.[3] ..... B01F 3/04

[52] U.S. Cl. ..... 261/61; 261/124; 261/DIG. 75; 366/167

[58] Field of Search ..... 261/DIG. 75, 124, 65, 261/61; 366/167, 179, 173

[56] References Cited

U.S. PATENT DOCUMENTS

| | | | |
|---|---|---|---|
| 945,143 | 1/1910 | Szamek | 366/167 |
| 1,706,418 | 3/1929 | Sissom | 366/173 |
| 2,105,165 | 1/1938 | Schnelz | 366/167 |
| 2,195,981 | 4/1940 | Conant | 261/DIG. 75 |
| 3,045,985 | 7/1962 | La Rock, Sr. | 366/167 |
| 3,484,214 | 12/1969 | Gehring et al. | 366/173 |
| 3,723,545 | 3/1973 | Nagel et al. | 261/DIG. 75 |
| 3,755,452 | 8/1973 | Sinn et al. | 366/173 |
| 3,904,393 | 9/1975 | Morse | 261/DIG. 75 |
| 4,042,510 | 8/1977 | Sullins | 261/DIG. 75 |
| 4,332,483 | 6/1982 | Hope et al. | 366/179 |

FOREIGN PATENT DOCUMENTS

| | | | |
|---|---|---|---|
| 95365 | 6/1922 | Switzerland | 261/DIG. 75 |
| 945086 | 12/1963 | United Kingdom | 366/173 |

*Primary Examiner*—Tim Miles

*Attorney, Agent, or Firm*—Caesar, Rivise, Bernstein & Cohen, Ltd.

[57] ABSTRACT

A mixing device for mixing at least two liquids to produce a homogenous mixture. The device includes an elongated chamber in which a vertically oriented elongated mixing cavity is located. The cavity is sealed at its lower end and it is open at its upper end and in communication with the interior of the chamber. An elongated conduit extends the length of the cavity and is adapted to receive liquids to be mixed. The conduit includes a plurality of ports located at longitudinally spaced positions therealong and which ports are directed in different directions. The ports create plural streams of liquid which interact and mix with one another within the cavity. The mixed liquids overflow the cavity and out its top end into the chamber 24. The chamber 24 includes an outlet from which the mixed liquids are withdrawn. In accordance with the preferred embodiment gas eductor means are provided in the inlet to the conduit to introduce gas bubbles within the cavity. Gas vent means are also provided in the device to vent any introduced gases from the device so that only the mixed liquids flow out the outlet.

18 Claims, 6 Drawing Figures

LIQUIDS TO BE MIXED
AIR
AIR
90°

LIQUID MIXING DEVICE

BACKGROUND OF THE INVENTION

This invention relates generally to mixing devices and more particularly to devices for mixing liquids to provide a uniform mixture.

Various apparatus are commercially available for the in-line mixing of liquids together to create a homogenous or uniform mixture. Such apparatus frequently make use of some dynamic means such as rotary blades, stirers, impellers, helical screws, etc., to effect the mixing operation. While such apparatus may be suitable for their intended purposes, they are necessarily complex and hence relatively expensive. Moreover such devices are generally unsuitable for mixing liquids in a low concentration ratio. A further drawback of such devices is that they commonly require some power source for operation.

Static or a passive in line mixing devices are also commercially available. Such devices make use of various mechanisms, such as baffles or other means to create turbulence in the liquids to effect the mixing operation. While such devices may eliminate the need for moving parts and power sources, such devices still leave much to be desired from the standpoint of simplicity of construction and effectiveness of operation, particularly in low concentrations.

OBJECTS OF THE INVENTION

Accordingly, it is a general object of the instant invention to provide an in-line mixing device which overcomes the disadvantages of prior art mixing devices.

It is a further object of the instant invention to provide a mixing device which is simple in construction and yet which is effective for producing a homogenous mixture of two or more liquids provided thereto.

It is still a further object of the instant invention to provide a mixing device which is easy to maintain.

It is still a further object of the instant invention to provide a device for mixing at least two liquids to produce a homogenous mixture and without necessitating the use of any moving components to effect mixing.

SUMMARY OF THE INVENTION

These and other objects of the instant invention are achieved by providing a device for mixing at least two fluids to produce a homogenous mixture. The device includes an inlet adapted for receipt of at least two fluids, a receiving chamber having an outlet and cavity means located within the chamber and having an opening in fluid communication with the receiving chamber. A conduit is located within the cavity means and is coupled to the inlet for receipt of the two fluids. The conduit includes stream producing means for producing at least two streams of the fluids. The streams are directed into the cavity means in at least two directions to effect a mixing action of said fluids. The mixed fluid overflows the cavity means out of its opening and into the receiving cavity for egress from the device via its outlet.

Other objects and many of the attendant advantages of this invention will be readily appreciated as the same becomes understood by reference to the following detailed description when considered in connection with the accompanying drawing wherein:

DETAILED DESCRIPTION OF PREFERRED EMBODIMENT

Figures 1, 2, 3, 4, 5:
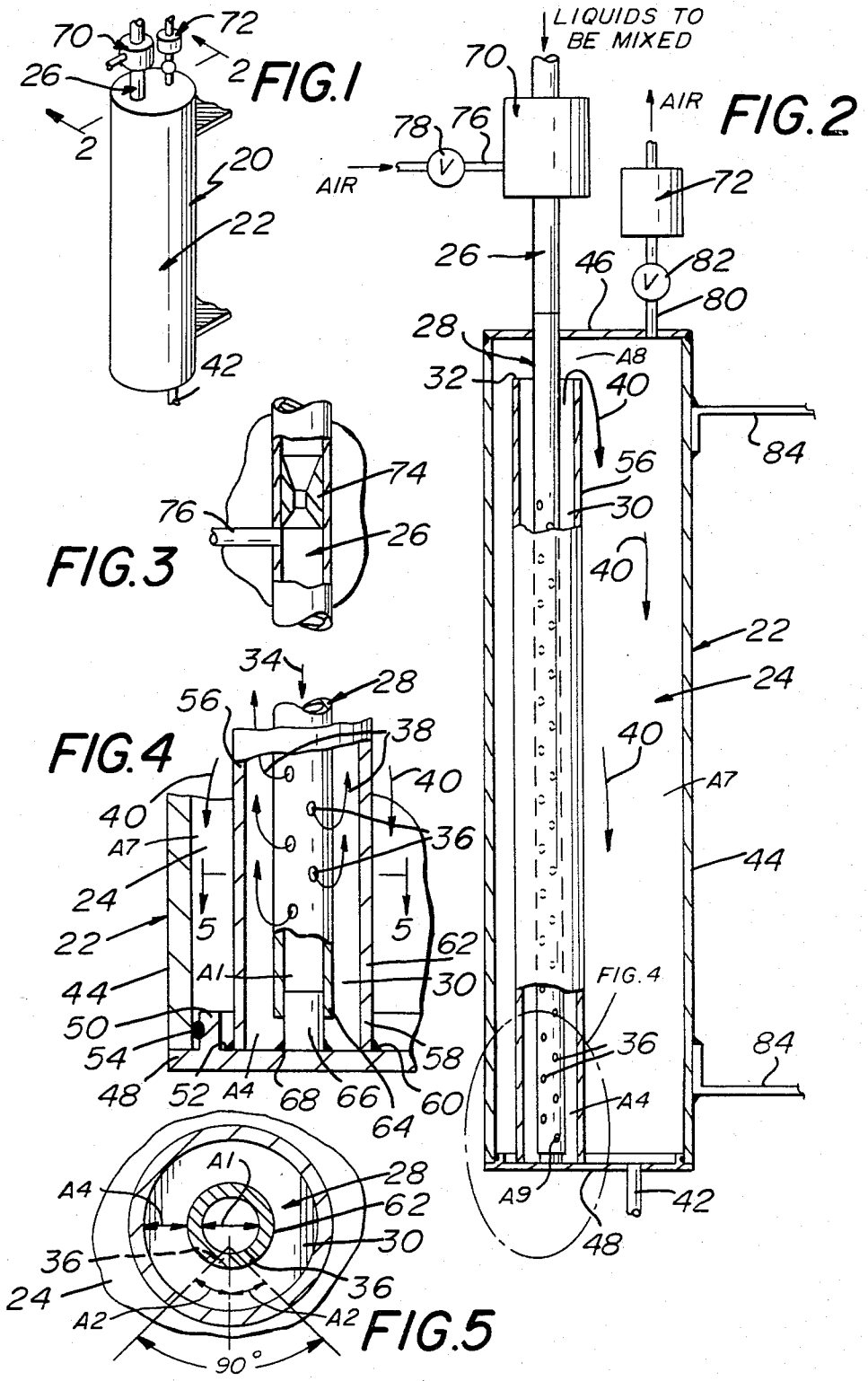
FIG. 1 is a perspective view of a mixing device constructed in accordance with the instant invention.
FIG. 2 is an enlarged sectional view taken along line 2—2 of FIG. 1.
FIG. 3 is an enlarged side elevational view, partially in section, of a portion of the device shown in FIG. 2.
FIG. 4 is an enlarged sectional view of a portion of the device shown within the area denoted "FIG. 4" in FIG. 2.
FIG. 5 is an enlarged sectional view taken along line 5—5 of FIG. 4.

Referring now to the various figures of the drawing wherein like reference characters refer to like parts, there is shown at 20 in FIG. 1 a mixing device constructed in accordance with the instant invention.

The device 20 is an "in-line" mixer which is arranged to effect the uniform and homogenous mixing of at least two fluids, e.g., gases or liquids, provided to it via some conduit from means (not shown). The device 20 is of general utility so that it can be used in any commercial or industrial application where uniformity of a fluid mixture is desired. Examples of such applications are in water treatment operations, dyeing operations, gas mixing applications, etc.

In the interests of expediting the discussion of the subject invention, it will be described hereinafter in the context of effecting the mixing of liquids. It must be borne in mind that as stated above usage of the subject invention is not limited to that application. Hence the device 20 can be used to effect the mixture of any fluids. Moreover, the device 20 has particular utility for mixing fluids injected into a conduit carrying another fluid by some periodically operating injection device, e.g., a pulsating pump. In such applications the injected liquid tends to remain as an agglomeration flowing in the conduit unless some mixing means are used to disperse and mix the fluids. Commercial in-line mixing devices have not provided suitable for such use.

As can be seen in FIG. 2 the device 20 basically comprises a housing or a shell 22 forming in its interior a fluid receiving chamber 24. The chamber includes an inlet 26 through which the two fluids to be mixed are introduced. Coupled to the inlet and within the chamber 24 is a flow diverting conduit means 28. The conduit means 28 extends into a mixing cavity 30 which is also located within the chamber 24 and is formed by a cylindrical sidewall (to be described later). The upper end of the mixing cavity 30 is open at 32 is thus in fluid communication with the interior of the chamber 24.

The flow diverting conduit is arranged to carry the fluids introduced into the device 20 through it in the direction of the arrow 34. As can be seen clearly in FIGS. 2 and 4 the conduit means 28 includes plural apertures or ports 36, the details of which will be described in detail later, for causing the fluids flowing though the conduit means to exit therefrom in plural streams into the mixing cavity 30. As will also be described in detail later the plural stream of fluid are directed in different directions within the cavity 30, as is shown by the arrows 38 in FIG. 4. This action causes each exiting fluid stream to form a swirling or eddy current within a zone contiguous with the aperture from which it is directed. Moreover, since the liquid in each zone is directed in the opposite direction as its immediately adjacent zone, a swirling or eddy current action results at the interface of immediately adjacent zones. The foregoing actions create turbulance in the liquids in the mixing cavity, thereby expediting the mixing process and the interspersion of the fluids within the cavity. The mixed fluids overflow the cavity 30 out of its open end 32 and into chamber 24 in a generally laminar-like flow as shown by the arrows 40 to complete the mixing of the fluids. The chamber 24 includes an outlet 42 through which the mixed fluids pass from the device 20 to the system in which the mixing device is connected.

The housing 22 basically comprises a cylindrical shell in the form of a circular sidewall 44 and having a top end sealed by a top wall 46 and a bottom end sealed by a bottom wall 48. The top wall 46 is fixedly secured, such as by welding to the sidewall 44. The bottom wall 48 is releasably secured by means (not shown) to the sidewall 44. As can be seen clearly in FIG. 4 the bottom wall 48 includes an annular flange 50 extending upward from the inside surface 52 of the sidewall and adjacent the outer periphery thereof. The flange is arranged to form a fluid tight seal with the sidewall 44 via the end use of a resilient gasket 54 interposed between the annular flange 50 and the interior surface of the sidewall 44 contiguous with the lower end thereof.

The releasable securement of the lower wall 48 to the device 20 is provided in order to provide ready access to the interior of the device for cleaning and maintenance thereof, as will be described later.

As can be seen in FIG. 2 the outlet 42 basically comprises a pipe or tube extending through the bottom wall 48. The mixing cavity 30 is formed by an elongated tube 56 of circular sidewall and having a lower end 58 which is fixedly secured to the interior surface 52 of the bottom wall 48 by a weld line 60 extending about the entire periphery thereof. The diameter of tube 56 is substantially smaller than the diameter of shell 44 but is still sufficiently large to provide an adequate volume for enabling the mixing of liquids therein. Exemplary dimensions of a mixing device constructed in accordance with this invention will be set forth later in this specification.

The flow diverting conduit 28 basically comprises an elongated conduit or pipe having a circular sidewall 62. The conduit 28 is of relatively small inside diameter as compared to cavity 30 and extends the full length of the interior of the chamber 24 from its connection at inlet 26 to its lower end 64. As can be seen in FIG. 4 the lower end 64 is closed by a plug or nipple 66 projecting upward from the inside surface 52 of the bottom wall 48. The nipple 66 is fixedly secured to the bottom wall 48 via a weld line 68. The nipple 66 is frictionally fit within the end 64 of the tube 28 to seal the end thereof. The upper end of the conduit means 28 is secured (by means not shown) to the inlet 26.

As will be appreciated by those skilled in the art since the tube 56 forming the cavity 30 is welded to the bottom wall 48 and since the bottom wall 48 can be removed from the sidewall 22 of the device, the removal of that bottom wall also removes the tube 56, thereby exposing the entire length of conduit means 28. This feature is of considerable importance to provide ready access to the conduit to effect the cleaning of the device, for periodic maintenance and for repair, if necessary.

As noted earlier the conduit means 28 includes plural apertures or ports 36 therein. These ports are located along substantially the entire length thereof, terminating at the point located somewhat below the top of the cavity 30 (for reasons to be described later). The ports 36 are equadistantly spaced in the longitudinal direction along the conduit 28. As can be seen in FIGS. 4 and 5 each of the immediately adjacent ports extends at an angle A2 of approximately 90° to each other. Thus the lower-most port is directed in one direction while the next higher port is directed at an angle of 90° to the lower-most port, and so forth and so on up the conduit 28. The angularly directed ports have the result of creating plural streams of fluids, with immediately adjacent streams extending in different directions from one another around cavity 30, as will be described later.

Figure 6:
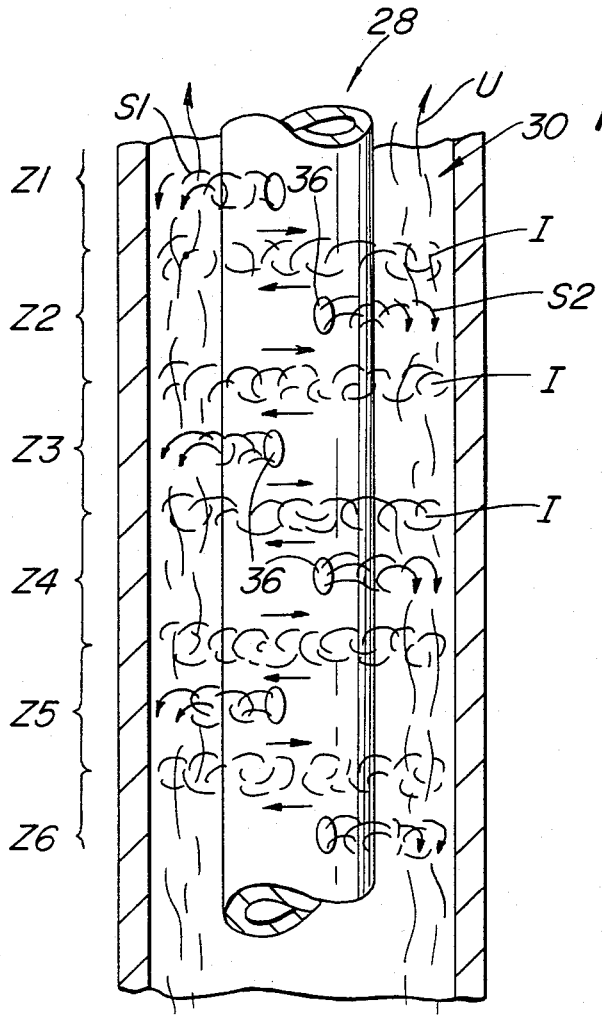
FIG. 6 is an enlarged sectional view of a portion of the device shown in FIG. 2 and showing the mixing action produced by said device.

When the input conduit to the device 20 is carrying a first liquid and a second liquid is injected therein, such as by the use of a conventional pulsating pump, the injected second liquid stays in an agglomeration or mass flowing down the conduit within the first liquid. As the injected (second) liquid mass reaches the first port in the conduit 28 a portion S1 (FIG. 6) thereof flows through the port 36 and into the cavity 30. The stream of the second liquid exits the port in a helical or eddy current flow and in a general direction extending at an acute angle A2 (FIG. 2) to the radius of conduit 28. This action causes the second liquid to flow in one rotational direction around cavity 30 in an associated zone Z1. Each zone comprises a portion of the volume of cavity 30 centered about the associated port. As the mass of second liquid reaches the next lower port 36 it also exits that port in an eddy current stream S2 flowing in the opposite rotational direction about cavity 30 in zone Z2. The above described actions repeat at each port as the mass of second liquid flows down conduit 28 until it reaches the lowermost port.

The plural sequentially located ports 36 have the effect of breaking up the mass of the second liquid by injecting portions thereof in sequential zones in the mixing chamber. As will be appreciated by those skilled in the art prior to the time that the first mass of the second liquid reaches the uppermost port 36 the first liquid will have been injected by the conduit 28 into the mixing cavity so that the mixing device will be full of the first liquid. Thus, the device 20 serves to disperse the mass of the second liquid along the length of the first liquid within mixing cavity.

The mixing of the first and second liquids in each zone is accomplished by virtue of the eddy current actions of the streams. In addition since the liquid in each zone is directed out of the associated port in the opposite rotational direction as the liquid in the immediately adjacent zone a swirling or eddy current action is created at the interface I (FIG. 6) of the two oppositely rotating liquid zones. Moreover, there is an upward flow U (FIG. 6) of the liquid through cavity 30. All of the foregoing effects cooperate to provide a turbulent or active mixing action in the cavity 30.

As the mixed liquids flow upward in stream U above the uppermost port the turbulent flow settles down to a substantially laminar flow (not shown). This action is effected by locating the uppermost port 36 below opening 32 by a distance of at least five times the diameter of the cavity 30 at its opening 32. Moreover, as the liquids flow through chamber 24 toward the outlet 42 the flow becomes completely laminar and by the time the liquids reach the outlet they are in the form of a homogenous mixture.

In accordance with the preferred embodiment of the instant invention the device 20 also includes educator means 70 for introducing gas, e.g., air, bubbles into the conduit 28. The gas bubbles (not shown) create additional turbulence within the cavity 30, thereby providing an additional mixing action. The gas bubbles flow upward with flow U and enter chamber 24 where they are vented to the ambient atmosphere via vent means 72.

The eductor 70 is a conventional device, such as sold by Schutte & Koerting division of Ametek, Inc. of Cornwells Heights, Pa. and designated as the Water Jet Eductor Model 264. Thus, the details of eductor 70 need not be described herein. Suffice it to say that the eductor includes a venturi orifice 74 disposed in a conduit communicating with inlet conduit 26 and through which the liquids to be mixed pass. A gas input line 76 is located downstream of the venturi throat and in communication with inlet line 26. A valve 78 is provided in line 76 to control the flow of gas therethrough.

The vent 72 is also of conventional construction, such as sold by Amtrol, Inc. and designated as Float Type Air Vent #7. Thus, the details of the vent 72 will not be described herein. The air vent 72 is connected in a vent line 80 downstream of a valve 82. The vent line 80 is in communication with the interior of chamber 24 at the top end thereof.

As can be seen in FIG. 2 the device 20 also includes a pair of mounting brackets 84. These mounting brackets are provided to serve as means for mounting the mixing device in the vertical orientation, such as shown in FIGS. 1 and 2.

One embodiment of the device 20 shown herein and which is effective for the homogenous mixing of pulse-fed fluids has the following dimensions: the fluid receiving chamber 24 is 24.5" (62.23 cm) high by 5.5" (13.97 cm) in diameter. The mixing cavity 30 is 22.5" (57.15 cm) high by 2" (5.08 cm) in diameter. The inside diameter of conduit 28 is 0.75 inch (1.91 cm). The diameter of each port 36 is 0.094" (2.38 mm) and the ports are spaced 1" (2.54 cm) apart.

Thus, for the device described above the volume A1 of fluid within the conduit 28 is 10.82 cubic inches (175.9 cubic centimeters), the volume A4 of fluid within cavity 30 is 52.88 cubic inches (0.867 cubic meters), the volume A7 of fluid within receiving chamber 24, excluding the portion above the opening 32 of cavity 30, is 484.37 cubic inches (7.94 cubic meters), with the volume A8 of the portion of the chamber 24 above the opening of cavity 30 being 7.95 cubic inches (130.3 cubic centimeters) and finally the volume of each mixing zone in the mixing chamber is 2.35 cubic inches (38.5 cubic centimeters).

With a typical flow rate of four gallons per minute through the conduit 28, the velocity of the fluid reaching the uppermost port 36 is 2.94 feet (0.896 meters) per second. As the fluid flows past each port a portion thereof flows out of the port at a velocity of approximately 13.06 feet (3.98 meters) per second. This velocity is sufficiently high for effective action but low enough to preclude any erosion of the conduit surfaces forming the port. The fluid reaching the lowest port flows at a velocity of approximately 0.2 feet (0.61 meters) per second. The velocity of the fluid flowing up the cavity increases with each succeeding port up the conduit from the velocity of approximately 0.038 feet (0.012 meters) per second to a terminal velocity of approximately 0.545 feet (0.166 meters) per second exiting through opening 32. The velocity of the liquid passing through the receiving chamber 24 is approximately 0.065 feet (0.02 meters) per second.

With the flow rate of four gallons per minute the dwell time of the fluid within any of the zones contiguous with a port is approximately 2.14 seconds, while the dwell time of the fluid through the receiving chambers 24 to the outlet is approximately 32.1 seconds.

It has been found that to insure proper mixing operation by the exemplary device 20 shown and described herein for the mixing of pulse fed liquids, e.g., liquids injected into a feed line by pulsating pumps, etc., the total volumetric capacity, per unit of time, of the mixing device must be no less than one-half of the flow rate (volume per unit of time) of the total liquids introduced into the device. Moreover, the volume of the higher volume liquid fed to the mixing device must be less than or equal to 2,500 times the volume of the injected or pulse fed liquid (the lower volume liquid). Furtherstill, the height of the mixing cavity 30 should be equal to the product of 0.0475 times the total volume of the two liquids entering the device per unit of time divided by the area of the cavity 30. As mentioned earlier, the distance from the highest port 36 to the top of the cavity 30 must be at least five times in diameter of the cavity to insure that the flow exiting the opening 32 of the cavity is substantially laminar.

Depending upon the type of application to be used and the liquids to be mixed, the device 20 can be formed of any suitable materials, such as stainless steel, plastics, etc. Moreover it must also be borne in mind that the device 20 can be constructed of alternate shapes and sizes than shown herein and still effect the uniform and homogenous mixture of various fluids introduced therein.

Without further elaboration the foregoing will so fully illustrate my invention that others may, be applying current or future knowledge, readily adapt the same for use under various conditions of service.

I claim:

1. Apparatus for mixing at least two fluids to produce a homogenous mixture, said apparatus having an inlet adapted for receipt of at least two fluids, a hollow receiving chamber having an outlet, an elongated hollow cylindrical member defining a cavity therein and being located within said chamber, said member being closed at one end thereof and having an opening adjacent the other end thereof, said opening being in fluid communication with said chamber, and an elongated conduit located within said cavity and coupled to said inlet for receipt of said two fluids, said conduit including plural, longitudinally spaced stream producing means for producing at least two longitudinally spaced streams of fluid, with each stream being directed into said cavity in a respective direction to produce a respective eddy current therein, and with immediately adjacent eddy currents flowing in opposite rotational directions to to effect a mixing action of said fluids, whereupon said mixed fluid flows out of said opening in said member and into said receiving chamber for egress from said apparatus via said outlet.

2. The Apparatus of claim 1 wherein each of said stream producing means comprises a respective orifice.

3. The apparatus of claim 2 wherein immediately adjacent orifices are directed at an angle to each other.

4. The apparatus of claim 3 wherein said angle is less than 180°.

5. The apparatus of claim 3 wherein said angle is approximately 90°.

6. The apparatus of claim 1 wherein said member comprises a cylindrical wall extending a substantial length of said chamber and having a closed bottom end and an open top end, said open top end forming said opening to said chamber, said conduit means comprising an elongated tube extending within said cavity means for a substantial length thereof.

7. The apparatus of claim 6 wherein each of said stream producing means comprise a respective orifice.

8. The apparatus of claim 7 wherein immediately adjacent orifices are directed at an angle to each other.

9. The apparatus of claim 8 wherein said angle is less than 180°.

10. The apparatus of claim 9 wherein said angle is approximately 90°.

11. The apparatus of claim 6 wherein each of said stream producing means comprises a respective orifice longitudinally spaced along said conduit means, with immediately adjacent orifices being directed at an angle to each other.

12. The apparatus of claim 11 wherein said angle is less than 180°.

13. The apparatus of claim 11 wherein said cavity means is disposed generally vertically within said chamber and wherein said conduit means is disposed generally vertically within said cavity means, said orifices being located in the lower portion of said conduit means, said upper portion of said conduit means being coupled to said inlet.

14. The apparatus of claim 13 wherein said outlet is at the bottom of said chamber.

15. The apparatus of claim 1 additionally comprising means for drawing gas into said conduit to create gas bubbles therein and vent means coupled to said receiving chamber for venting said gas therefrom so that only mixed liquid exits said chamber through said outlet.

16. The apparatus of claim 15 additionally comprising venturi means coupled to said inlet and cooperating with said means for drawing gas into said conduit.

17. The apparatus of claim 13 additionally comprising means for drawing gas into said conduit to create gas bubbles therein and vent means coupled to said receiving chamber for venting said gas therefrom so that only mixed liquid exits said chamber through said outlet.

18. The apparatus of claim 17 additionally comprising venturi means coupled to said inlet and cooperating with said means for drawing gas into said conduit.

* * * * *